US012528107B2

(12) United States Patent
Daube et al.

(10) Patent No.: US 12,528,107 B2
(45) Date of Patent: Jan. 20, 2026

(54) METHOD AND CONTROL DEVICE FOR OPERATING A STRIP TREATMENT INSTALLATION FOR PROCESSING A STRIP, IN PARTICULAR A METAL STRIP OR ROLLING MATERIAL

(71) Applicant: SMS group GmbH, Düsseldorf (DE)

(72) Inventors: Thomas Daube, Duisburg (DE); Lutz Kümmel, Jüchen (DE); Holger Behrens, Erkrath (DE)

(73) Assignee: SMS group GmbH, Düsseldorf (DE)

( * ) Notice: Subject to any disclaimer, the term of this patent is extended or adjusted under 35 U.S.C. 154(b) by 351 days.

(21) Appl. No.: 18/279,770

(22) PCT Filed: Feb. 21, 2022

(86) PCT No.: PCT/EP2022/054180
§ 371 (c)(1),
(2) Date: Aug. 31, 2023

(87) PCT Pub. No.: WO2022/207184
PCT Pub. Date: Oct. 6, 2022

(65) Prior Publication Data

US 2024/0307936 A1 Sep. 19, 2024

(30) Foreign Application Priority Data

Apr. 1, 2021 (DE) ..... 10 2021 203 357.1

(51) Int. Cl.
*B21B 39/02* (2006.01)
*B21B 1/22* (2006.01)

(52) U.S. Cl.
CPC ..... *B21B 39/02* (2013.01); *B21B 1/22* (2013.01)

(58) Field of Classification Search
None
See application file for complete search history.

(56) References Cited

U.S. PATENT DOCUMENTS 7,530,250 B2 * 5/2009 Hartung ..... B21D 1/02 72/8.6
2007/0017952 A1 1/2007 Carnevale et al.
(Continued)

FOREIGN PATENT DOCUMENTS

CN 101850913 A 10/2010
CN 104043686 A 9/2014
(Continued)

*Primary Examiner* — Ryan A Jarrett
(74) *Attorney, Agent, or Firm* — Smartpat PLC

(57) ABSTRACT

A metal strip is guided on transportation rollers through a strip treatment installation. The installation includes successive strip movement control devices along a transportation direction. The strip movement control devices detect and adjust the position of the strip transverse to the transportation direction. A method for operating the installation includes: detecting the position of the strip transverse to the transportation direction by sensors of upstream strip movement control devices; identifying properties that influence the position of the strip transverse to the transportation direction of the strip by the sensors; assigning the identified properties of the strip to corresponding points or segments of the strip; and proactively adjusting the position of the strip transverse to the transportation direction at downstream strip movement control devices based on the properties for the corresponding points or segments of the strip identified by the upstream strip movement control devices.

19 Claims, 1 Drawing Sheet

(56) References Cited

U.S. PATENT DOCUMENTS

| | | | | |
|---|---|---|---|---|
| 2011/0012972 | A1 | 1/2011 | Nitta | |
| 2014/0174141 | A1* | 6/2014 | Karner | B21B 39/084 72/224 |
| 2019/0041812 | A1 | 2/2019 | Gafur et al. | |
| 2019/0071750 | A1* | 3/2019 | Biglari | C21D 8/0278 |
| 2021/0207264 | A1 | 7/2021 | Kümmel et al. | |

FOREIGN PATENT DOCUMENTS

| | | | |
|---|---|---|---|
| CN | 108546897 | A | 9/2018 |
| CN | 108714673 | A | 10/2018 |
| CN | 112218973 | A | 1/2021 |
| DE | 102018215100 | A1 | 11/2019 |
| EP | 3202502 | A1 | 8/2017 |
| JP | H05214448 | A | 8/1993 |
| JP | H05214452 | A | 8/1993 |
| JP | H06345304 | A | 12/1994 |
| JP | 2011032505 | A | 2/2011 |
| JP | 2014223972 | A | 12/2014 |
| JP | 2017171419 | A | 9/2017 |
| JP | 2018192490 | A | 12/2018 |
| JP | 2020083625 | A | 6/2020 |
| WO | 2009030388 | A1 | 3/2009 |

* cited by examiner

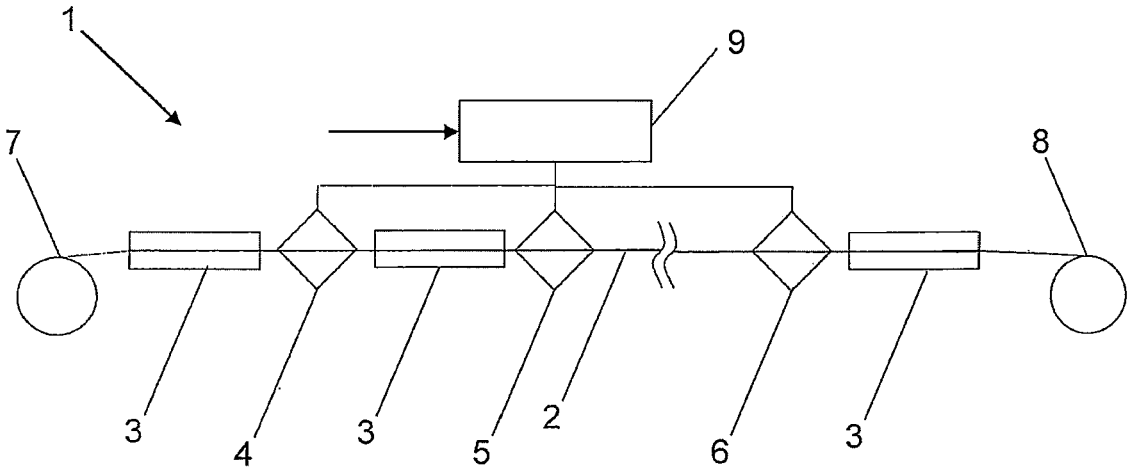
1
9
7
8
3
4
3
5
2
6
3

METHOD AND CONTROL DEVICE FOR OPERATING A STRIP TREATMENT INSTALLATION FOR PROCESSING A STRIP, IN PARTICULAR A METAL STRIP OR ROLLING MATERIAL

CROSS-REFERENCE TO RELATED APPLICATION

This application is a national stage application, filed under 35 U.S.C. § 371, of International Patent Application PCT/EP2022/054180, filed on Feb. 21, 2022, which claims the benefit of German Patent Application DE 10 2021 203 357.1, filed on Apr. 1, 2021.

TECHNICAL FIELD

The disclosure relates to a method for operating a strip treatment installation for processing a strip, in particular a metal strip or rolling material. The disclosure further relates to a control device for operating a strip treatment installation for processing a strip, in particular a metal strip or rolling material.

BACKGROUND

During the production, treatment and processing of metal strips, the strip, in particular a metal strip or rolling material, is guided through the treatment installation along a transportation direction. The strip may be delivered in material rolls, so-called coils, and unwound at the inlet of the strip treatment installation. After processing by the treatment installation, the processed strip can be rewound into a coil in order to facilitate transportation.

Thereby, the strip is guided through the treatment installation by transportation rollers. Due to its geometric shape, the strip tends to run laterally, i.e., transversely to the transportation direction, away from the transportation rollers, in particular deflection rollers. In order to ensure the position of the strip at the transportation rollers, the treatment installation comprises a plurality of successive strip movement control devices spaced apart from one another along the transportation direction. The distance between the strip movement control devices of a strip treatment installation can be several hundred meters, for example 300 to 500 m, wherein the strip movement control devices are typically autonomous from one another.

The strip movement control devices serve to keep the strip in the center of the transportation rollers transverse to the transportation direction, or in another fixed position transverse to the transportation direction. This ensures uniform treatment of the strip by the treatment installation and prevents damage to the strip or the treatment installation.

The strip movement control devices are therefore designed to detect and adjust the position of the strip transverse to the transportation direction. For this purpose, the strip movement control devices each comprise sensors for determining the position of the strip transverse to the transportation direction and actuators for adjusting the position of the strip transverse to the transportation direction.

For example, the sensors detect one or both lateral edges of the strip. Furthermore, inductive measuring frames or image sensors including image evaluation are known from the prior art.

The actuators are designed, for example, as swiveling rollers, which transfer a movement component to the strip transverse to the main transportation direction. The sensors and actuators of a strip movement control device are connected to a control logic, which controls the actuators on the basis of the sensor data.

Thus, the strip movement control devices each detect the position of the strip in the strip treatment installation by means of the sensors, in particular transverse to the transportation direction. From the sensor data, the logic calculates a deviation of the strip from the target position, usually the center of the transportation rollers transverse to the transportation direction, and initiates a correction of the position of the strip transverse to the transportation direction by means of the actuators.

A corresponding strip movement control device is disclosed, for example, in WO 2009/030388 A1.

However, in the known prior art, there is a problem with rapid changes in strip shape, such as a so-called "dog-leg" in the region of weld seams, for example when welding successive strips to be treated. This results in a rapid change of the strip position and, consequently, a large deviation and rapid change from the strip target position. The logic of a strip movement control device reacts to this with a strong correction by the actuator system. The problem is exacerbated by the fact that the sensor and actuator of the strip movement control device are sometimes several meters apart. Therefore, as a whole, in the region of rapid changes in the strip shape, strong control interventions or even faulty interventions arise, which can have a negative influence on the strip treatment of the strip, on the strip itself and/or the positioning of the strip.

Another problem with the prior art is rolling material with major defects transverse to the longitudinal direction of the strip, also called strip sabers. If the strip has such a shape transverse to the longitudinal direction, there is a large deviation from the strip target position to the next strip movement control device. Since the strip target position is usually in the center of the strip transportation rollers, depending on the direction of the error transverse to the longitudinal direction, it can occur in both directions transverse to the center of the strip transportation rollers. In order to be able to compensate for such errors, in the prior art, the width of the transportation rollers and, if necessary, the clear passage width of the strip treatment installation is extended accordingly. Since strip treatment installations can be several hundred meters long, this results in considerable additional costs.

Furthermore, errors can arise during strip treatment if, during treatment, the strip is not in the desired position, in particular the center of the transportation rollers. This is particularly the case with inline dressing systems, coaters, heat treatment devices or trimming shears.

SUMMARY

The disclosure is based on the object of developing a method and a control device for operating a strip treatment installation for processing a strip, in particular a metal strip or rolling material, which reduces the negative influences of both rapid changes in the strip shape, such as so-called "dog-legs" in the region of weld seams, and larger defects transverse to the longitudinal direction of the strip, such as so-called "strip sabers," and thus prevents damage to the strip and the strip treatment installation, avoids malfunctions and additionally reduces the production costs of the strip treatment installation.

The object is achieved by a method for operating a strip treatment installation for processing a strip, in particular a metal strip or rolling material, wherein the strip is guided by transportation rollers along a transportation direction through the strip treatment installation and the strip treatment installation comprises at least two successive strip movement control devices along the transportation direction, wherein the strip movement control devices are designed to detect and adjust the position of the strip transverse to the transportation direction, comprising the steps of:

detecting the position of the strip transverse to the transportation direction by means of sensors, in particular sensors of the strip movement control devices of the strip treatment installation, identifying properties of the strip by means of the sensors, said properties influencing the position of the strip transverse to the transportation direction, assigning the identified properties of the strip to corresponding points or segments of the strip, and proactively adjusting the position of the strip transverse to the transportation direction at the strip movement control devices following in the transportation direction on the basis of the properties for the corresponding points or segments of the strip that are identified by upstream sensors, in particular upstream strip movement control devices.

"Strip" within the context of the disclosure corresponds in particular to metal strips or rolling material. "Transverse to the transportation direction" corresponds to a movement perpendicular to the transportation direction in the strip plane.

The position of the strip transverse to the transportation direction is detected by means of suitable sensors. In particular, these are sensors of the strip movement control devices of the strip treatment installation. For example, the sensors detect one or both lateral edges of the strip. Furthermore, inductive measuring frames or image sensors including image evaluation can also be used.

On the basis of the sensor data, properties of the strip are subsequently determined, which influence the position of the strip transverse to the transportation direction. These are in particular so-called "dog-legs" in the region of weld seams, strip sabers or comparable strip properties. For example, the sensor data is used to identify if the vertical position of the strip changes rapidly transverse to the transportation direction, which corresponds to a dog-leg of the strip. A slow and steady change in the position of the strip transverse to the transport axis detects a so-called "strip saber." Thus, irregularities of the strip, which influence the position of the strip transverse to the transportation direction, are identified.

Based on the sensor data, the first strip movement control device will, if no further information is available, perform a control intervention and correct the position of the strip transverse to the transport axis by means of the associated actuator system of the strip movement control device. In the event of a dog-leg, this can lead to abrupt changes that can possibly have a negative effect on the strip and/or the strip treatment installation, in particular the corresponding strip movement control device. Since there is usually a certain distance between the sensor and the actuator of the strip movement control device, and continuous changes, as with a strip saber, are always associated with a control delay, the strip initially runs out of the strip target position, i.e., in a direction transverse to the transportation direction, before the strip movement control device corrects the strip position back to the strip target position. As such, the width of the transportation rollers must be designed larger than the actual width of the strip, which can lead to considerable additional costs, in particular for very long strip treatment installations.

"Transportation roller" within the context of the disclosure refers not only to single rollers, but also from trans-regions with a plurality of rollers to form a transport surface.

The properties identified, which influence the position of the strip transverse to the transportation direction, are assigned to the corresponding points or segments of the strip. The data detected by means of the sensors and subsequently evaluated are thus assigned to the corresponding points or segments of the strip.

the position of the strip transverse to the transportation direction is proactively adjusted at the strip movement control devices following in the transportation direction on the basis of the properties detected by upstream sensors, in particular by upstream strip movement control devices, for the corresponding points or segments of the strip. A proactive adjustment within the context of the disclosure relates in particular to an early preparation of the adjustments to be carried out to the position of the strip transverse to the transportation direction, such that the adjustments can be carried out with the occurrence of the identified properties of the strip. This significantly reduces the control delay that would otherwise normally arise. Further, the proactive adjustment can also include a more uniform adjustment of the position of the strip transverse to the transportation direction, although the identified property concerns a rapid change in the position of the strip transverse to the transportation direction. This significantly improves the running smoothness. Furthermore, proactive adjustment can also involve omitting adjustments to the position of the strip transverse to the transportation direction, in particular for rapid and short-term properties that affect the position of the strip transverse to the transportation direction only for a very limited range.

The identified strip properties are responded to at an early stage, i.e., proactively, on the basis of the detected and evaluated sensor data on strip movement control devices, in order to avoid unnecessary or abrupt control interventions and to make the entire transport of the strip smoother and more harmonious. Proactive adjustment can be performed by the strip movement control devices at the optimum point in time, since the identified properties have been assigned to corresponding points or segments of the strip and the position of the points or segments in the strip treatment installation can be easily determined at any time.

According to a variant, the method comprises the step of forwarding the identified properties with the corresponding points or segments of the strip from an upstream strip movement control device at least to the downstream strip movement control device in the transportation direction, preferably a plurality of the downstream strip movement control devices. Thus, the method is implemented in the controls of the strip movement control devices and the corresponding data are transferred from the upstream strip movement control devices to one or more of the downstream strip movement control devices. This can preferably be effected via already existing means of communication, using other components or parts of the installation as well, such as a central control unit.

In an alternative or additional variant, the method comprises transmitting the identified properties with the corresponding points and segments of the strip from the strip movement control devices to a computing device, wherein the computing device optimizes the position of the strip transverse to the transportation direction for the transport of the strip through the strip treatment installation on the basis of the transmitted properties with the corresponding points and segments. In particular, the computing device can optimize the transport of the strip through the entire strip treatment installation and make appropriate proactive adjustments to the position of the strip transverse to the transportation direction for all strip movement control devices. The computing device enables a holistic optimization for the transport of the strip through the strip treatment installation.

In accordance with an expedient variant, the optimization is based on machine learning methods or simulations, in particular for minimizing strip damage, avoiding uneven strip treatment by the strip treatment installation, minimizing the width of the strip treatment installation, avoiding damage to the strip treatment installation, in particular to the transport device and strip movement control devices, avoiding unnecessary downtimes of the strip treatment installation, for example due to emergency situations, or comparable optimization objectives. Thus, in particular, a data-driven model is used to optimize the strip target position for the entire transport through the strip treatment installation.

According to one variant, proactive adjustment of the position of the strip transverse to the transportation direction is performed at the strip movement control device following in the transportation direction on the basis of the optimization of the computing device. For this purpose, the result of the optimization is transmitted from the computing device to the downstream strip movement control device, wherein the optimization expediently takes into account the data of all upstream strip movement control devices.

In an advantageous variant, the method comprises the step of comparing the position of the strip transverse to the transportation direction optimized by the computing device with the actual position of the corresponding points or segments of the strip at the strip movement control devices and, if necessary, adjusting the actual position of the strip transverse to the transportation direction by the strip movement control devices. For each strip movement control device, the actual position of the strip is thus compared with the optimized position of the strip determined by the computing device and corrected accordingly in the event of deviations.

According to one variant, the method comprises feeding back to the computing device the deviations between the position of the strip transverse to the transportation direction optimized by the computing device with the actual position of the corresponding points or segments of the strip for improving the optimization. On the basis of such information, the proactive adjustment of the position of the strip transverse to the transportation direction at the corresponding strip movement control device following in the transportation direction can be further improved, in particular performed more uniformly. The computing device can also use this information to assess and improve the quality and accuracy of the optimization. In particular, machine learning algorithms can be further trained using such feedback.

According to a variant, the method comprises taking into account optimizations from the past with respect to the processing of another strip by the strip treatment installation when optimizing the position of the current strip transverse to the transportation direction by the computing device. This means that experience from previous optimizations is taken into account in the current optimization. If the previous proactive adjustments have proven to be effective for certain previously identified properties that affect the position of the strip transverse to the transportation direction, such proactive adjustments can be applied to comparable identified properties that affect the position of the strip transverse to the transportation direction, either accordingly or in a modified form, in order to take into account special features of the current strip, if necessary.

In a particularly useful variant, the method comprises training optimization algorithms on the basis of past optimizations with respect to the processing of another strip by the strip treatment installation. The algorithms used for optimization, i.e., for determining the proactive adjustment of the position of the strip transverse to the transportation direction at the strip movement control devices following in the transportation direction, are trained with data sets from the past, from other comparable strip treatment installations as well. This improves the initial accuracy of the optimization algorithms used.

In accordance with an advantageous variant, the proactive adjustment of the position of the strip transverse to the transportation direction at the downstream strip movement control devices in the transportation direction takes into account the adjustments of the position of the strip transverse to the transportation direction carried out at the upstream strip movement control devices. If the proactive adjustment made at the previous strip movement control device has proven beneficial, the proactive adjustment at the subsequent strip movement control device can adopt it or at least use it as the basis for its own proactive adjustment. This allows the proactive adjustments of the strip movement control devices along the strip treatment installation to improve continuously. This is particularly advantageous in conjunction with the computing device for optimizing the position of the strip transverse to the transportation direction, since the computing device can thereby better optimize the transport of the strip through the entire strip treatment installation. For this purpose, the computing device can compare and evaluate the proactive adjustments of the successive strip movement control devices along the strip treatment installation. By means of such variant, in particular, changes to the identified properties that influence the position of the strip transverse to the transportation direction can be identified along the strip treatment installation and taken into account during optimization. For example, the strip treatment installation includes stretcher levelers, furnaces or other devices that change the properties of the strip, including the properties of the strip that affect its position transverse to the transportation direction. By taking into account the proactive adjustments of the successive strip movement control devices along the strip treatment installation, such changes can be identified and taken into account during optimization.

According to a further preferred variant, the method comprises the step of taking into account information and/or data from installations upstream of the strip treatment installation during the proactive adjustment of the position of the strip transverse to the transportation direction and/or the optimization of the position of the strip transverse to the transportation direction by the computing device, in particular for the proactively adjustment and/or optimization of the position of the strip transverse to the transportation direction at the first strip treatment installation in the transportation direction of the strip treatment installation. According to an expedient variant, the upstream installations are selected from: Hot rolling mill, cold rolling mill, pickling line, welding machines, in particular four-point sensors or quality monitoring system of the welding machine, coiling device, or the like. As a result, the method already has information and/or data on the strip before it is processed in the strip treatment installation, which can be taken into account during optimization. In particular, this already enables proactive adjustment of the position of the strip transverse to the transportation direction at the first strip movement control device of the strip treatment installation. For example, information and/or data from the upstream installations can be used to determine properties of the strip that influence the position of the strip transverse to the transportation direction. The information and/or data from the upstream installations are, for example, asymmetries from a rolling mill (wedge, force difference, asymmetrical setting force, signal from flatness measuring roll), information from the setting system (flattener, stretcher leveler, skin pass mill), or the like.

In an expedient variant, the method further comprises the step of determining the position of points or segments of the strip in the strip treatment installation, in particular on the basis of tracking systems of the strip treatment installation. This can ensure that the downstream strip treatment installation makes the proactive adjustments for optimization at the exact point in time or time window when the strip has the appropriate feature, which adjustments affect the position of the strip transverse to the transportation direction. The position determination is based, for example, on monitoring the transport speed, for example by means of drive rollers of the strip treatment installation or the like.

In accordance with an advantageous variant, the method comprises the step of detecting the position of the strip transverse to the transportation direction between two strip movement control devices and transmitting the detected position to the upstream strip movement control device, the downstream strip movement control device and/or the computing device. This makes it possible, for example, to check whether the proactive adjustments made are achieving the desired result. Moreover, the downstream strip movement control device or the computing unit can detect newly occurred position changes of the strip relative to the transportation direction and take them into account in the downstream strip treatment installation or in optimization in general.

According to a further preferred variant, the distance between two successive strip movement control devices is smaller at the beginning of the strip treatment installation than at the end of the strip treatment installation; in particular, the distance between two successive strip movement control devices increases in the transportation direction. As a result, more information is available for optimization at the start of the strip treatment installation, and the position of the strip transverse to the transportation direction can be set more precisely at the start of the strip treatment installation. As the transport length increases, more information is available, in particular with respect to optimized positioning of the strip transverse to the transportation direction, in order to compensate for strip irregularities.

In an expedient variant, the method is carried out continuously.

According to a particularly advantageous variant, the method comprises taking into account information from the strip movement control devices, in particular current information with respect to the adjustment of the position of the strip transverse to the transportation direction. The information to be taken into account is, for example, current angles of attack of transportation rollers of the strip movement control device, alignments of parts or of the entire strip movement control device or comparable information. The information is taken into account in particular when identifying properties of the strip that influence the position of the strip transverse to the transportation direction or when proactively adjusting the position of the strip transverse to the transportation direction.

In a further variant, adjustments to the strip movement control devices are taken into account during the proactive adjustment of the position of the strip transverse to the transportation direction. The properties of the strip movement control devices can change, for example, due to maintenance work or the replacement of components, or due to wear over time, i.e., generally long-term changes.

The object is further achieved by a control device for operating a strip treatment installation for processing a strip, in particular a metal strip or rolling material, wherein the strip is guided by transportation rollers along a transportation direction through the strip treatment installation and the strip treatment installation comprises a plurality of successive strip movement control devices along the transportation direction, wherein the strip movement control devices are designed to detect and adjust the position of the strip transverse to the transportation direction, wherein the control device is designed to carry out the method.

BRIEF DESCRIPTION OF THE DRAWINGS

The invention is explained in more detail below with reference to an exemplary embodiment shown in the FIGURE.

FIG. 1 shows a schematic view of a strip treatment installation for processing a strip that implements the disclosed method.

DETAILED DESCRIPTION

FIG. 1 shows a schematic view of a strip treatment installation 1 for processing a strip 2, in particular a metal strip or rolling material. In the strip treatment installation 1, the strip 2 is guided through the strip treatment installation 1 along a transportation direction by transportation rollers 3. In the exemplary embodiment shown in FIG. 1, the transportation direction is horizontal from left to right. Furthermore, the strip treatment installation comprises at least two successive strip movement control devices 4, 5, 6 along the transportation direction. In accordance with the exemplary embodiment of FIG. 1, the strip treatment installation 1 comprises a total of n strip movement control devices 4, 5, 6. The strip movement control devices 4, 5, 6 are each designed to detect and adjust the position of the strip 2 transverse to the transportation direction.

Since the strip 2 is often delivered in material rolls, so-called "coils," there is often a decoiler 7 at the inlet of the strip treatment installation 1. For easier further transport, a coiler 8 can be arranged at the end of the strip treatment installation 1, in order to wind the strip 2 back into a coil.

The strip 2 is guided through the treatment installation 1 by the transportation rollers 3. The individual transportation rollers 3 can each comprise a plurality of separate rollers, which form a support and transport surface for the strip 2. Due to its geometric shape, the strip 2 tends to run laterally, i.e., transversely to the transportation direction, from the transportation rollers 3, in particular deflection rollers. The strip movement control devices 4, 5, 6 serve to ensure the position of the strip 2 on the transportation rollers 3. In particular, the strip movement control devices 4, 5, 6 hold the strip in the center of the transportation rollers 3 transverse to the transportation direction or in another fixed position transverse to the transportation direction.

The strip movement control devices 4, 5, 6 each comprise sensors for determining the position of the strip 2 transverse to the transportation direction and actuators for adjusting the position of the strip 2 transverse to the transportation direction.

For example, the sensors detect one or both lateral edges of the strip 2. Furthermore, inductive measuring frames or image sensors including image evaluation are known from the prior art.

The actuators are designed, for example, as swiveling rollers, which transmit a speed component to the strip 2 transverse to the main transportation direction.

The strip treatment installation 1 of FIG. 1 implements the method for operating a strip treatment installation 1 for processing a strip 2, in particular a metal strip or rolling material, comprising the steps of:

- detecting the position of the strip 2 transverse to the transportation direction by means of sensors, in particular sensors of the strip movement control devices 4, 5, 6 of the strip treatment installation 1,
- identifying properties of the strip 2 by means of the sensors, said properties influencing the position of the strip 2 transverse to the transportation direction,
- assigning the identified properties of the strip 2 to corresponding points or segments of the strip 2, and
- proactively adjusting the position of the strip 2 transverse to the transportation direction at the strip movement control devices 5, 6 following in the transportation direction on the basis of the properties for the corresponding points or segments of the strip 2 that are identified by upstream sensors, in particular upstream strip movement control devices 4, 5.

In accordance with the exemplary embodiment of FIG. 1, the position of the strip 2 transverse to the transportation direction is detected at the first strip movement control device 4 by means of suitable sensors, in particular by means of sensors of the first strip movement control device 4. By means of the sensor data, properties of the strip that influence the position of the strip transverse to the transportation direction are identified. The identified properties of the strip are assigned to the corresponding points or segments of the strip 2.

At the following strip movement control devices 5, 6 in the transportation direction, i.e., the second strip movement control device 5 up to the nth strip movement control device 6, the position of the strip 2 transverse to the transportation direction can be proactively adjusted on the basis of the identified properties for the corresponding points or segments of the strip 2.

For this purpose, for example, the identified properties with the corresponding points or segments of the strip 2 are forwarded by the first strip movement control device 4 at least to the second strip movement control device 5 following in the transportation direction, preferably to all subsequent strip movement control devices 6. Alternatively or additionally, the identified properties with the corresponding points and segments of the strip 2 are transmitted from the strip movement control devices 4, 5, 6 to a computing device 9. On the basis of the transmitted properties with the corresponding points and segments, the computing device 9 optimizes the position of the strip 2 transverse to the transportation direction for the transport of the strip 2 through the strip treatment installation 1, in particular the transport of the strip 2 through the entire strip treatment installation 1.

The optimization is based, for example, on machine learning methods or on simulations, in particular for minimizing strip damage, avoiding uneven strip treatment by the strip treatment installation, minimizing the width of the strip treatment installation, avoiding damage to the strip treatment installation, in particular to the transport device and strip movement control devices, avoiding unnecessary downtimes of the strip treatment installation, for example due to breakdowns, or comparable optimization objectives.

The proactive adjustment of the position of the strip 2 transverse to the transportation direction at the strip movement control device 5, 6 following in the transportation direction is thereby preferably carried out on the basis of the optimization of the computing device 9. In this case, the position of the strip 9 optimized by the computing device 9 transverse to the transportation direction is compared with the actual position of the corresponding points or segments of the strip 9 at the subsequent strip movement control devices 5, 6 and, if necessary, the actual position of the strip 2 transverse to the transportation direction is adjusted by the strip movement control devices 5, 6. The identified deviations between the position of the strip 2 across the transportation direction optimized by the computing device 9 with the actual position of the corresponding points or segments of the strip 2 are fed back to the computing device 9 in order to improve the optimization.

In order to improve the optimization of the position of the current strip 2 transverse to the transportation direction by the computing device 9, optimizations from the past with respect to the processing of another strip 2 by the strip treatment installation 1 can be taken into account. In particular, optimization algorithms can be trained on the basis of past optimizations with respect to the processing of a different strip 2 by the strip treatment installation 1.

According to a preferred variant, the proactive adjustment of the position of the strip 2 transverse to the transportation direction at the downstream strip movement control devices 5, 6 in the transportation direction takes into account the adjustments of the position of the strip 2 transverse to the transportation direction carried out at the upstream strip movement control devices 4, 5. For this purpose, the strip movement control devices 4, 5, 6 can transmit the performed adjustments of the position of the strip 2 transverse to the transportation direction to the computing device 9, and the computing device 9 can take the transmitted adjustments into account when optimizing the position transverse to the transportation direction.

According to a particularly advantageous variant, the method comprises the step of taking into account information and/or data from installations upstream of the strip treatment installation 1 when proactively adjusting the position of the strip 2 transverse to the transportation direction and/or optimizing the position of the strip 2 transverse to the transportation direction by the computing device 9. This is particularly advantageous for proactively adjusting and/or optimizing the position of the strip transverse to the transportation direction at the first strip treatment installation 4 in the transportation direction of the strip treatment installation 1. For example, the upstream installations are selected from: Hot rolling mill, cold rolling mill, pickling line, welding machines, in particular four-point sensors or quality monitoring system of the welding machine, decoiling device 7, or the like. In accordance with the exemplary embodiment from FIG. 1, information from the decoiling device 7 in particular can be taken into account, such that information for proactively adjusting the position of the strip 2 transverse to the transportation direction is already available at the first strip movement control device 4.

The method further determines the position of points or segments of the strip 2 in the strip treatment installation 1, in particular on the basis of tracking systems of the strip treatment installation 1.

The method can further comprise the step of detecting the position of the strip 2 transverse to the transportation direction between two strip movement control devices 4, 5, 6 and transmitting the detected position to the upstream strip movement control device 4, 5, the downstream strip movement control device 5, 6 and/or the computing device 9. For this purpose, separate sensors are preferably used to detect the position of the strip 2 transverse to the transportation direction. In particular, such a sensor can be arranged at the beginning of the strip treatment installation 1, such that information is already available at the first strip movement control device 4 for a proactive adjustment of the position of the strip 2 transverse to the transportation direction.

According to an advantageous embodiment, the distance between two successive strip movement control devices 4, 5, 6 is smaller at the beginning of the strip treatment installation 1 than at the end of the strip treatment installation 1; in particular, the distance between two successive strip movement control devices 4, 5, 6 increases in the transportation direction.

It is expedient that the method is carried out continuously.

Furthermore, the method comprises the step of taking into account information from the strip movement control devices 4, 5, 6, in particular current information with respect to the adjustment of the position of the strip 2 transverse to the transportation direction. The information to be taken into account is, for example, current angles of attack of transportation rollers of the strip movement control device 4, 5, 6, alignments of parts or of the entire strip movement control device 4, 5, 6 or comparable information. In particular, the information is taken into account when identifying properties of the strip 2 that influence the position of the strip 2 transverse to the transportation direction or when proactively adjusting the position of the strip 2 transverse to the transportation direction.

In a further variant, adjustments to the strip movement control devices 4, 5, 6 are taken into account during the proactive adjustment of the position of the strip 2 transverse to the transportation direction. The properties of the strip movement control devices 4, 5, 6 can change, for example, due to maintenance work or the replacement of components, or due to wear over time, i.e., generally long-term changes.

LIST OF REFERENCE SIGNS

1 Strip treatment installation
2 Strip
3 Transportation rollers
4 First strip movement control device
5 Second strip movement control device
6 $n^{th}$ strip movement control device
7 Decoiler
8 Coiler
9 Computing device

The invention claimed is:

1. A method for operating a strip treatment installation for processing a strip, wherein the strip is guided through the strip treatment installation along a transportation direction by transportation rollers, and wherein the strip treatment installation comprises at least two successive strip movement control devices including at least one upstream strip movement control device and at least one downstream strip movement control device along the transportation direction, and wherein the at least two successive strip movement control devices are designed to detect and adjust a position of the strip transverse to the transportation direction, the method comprising:

detecting the position of the strip transverse to the transportation direction by sensors of the at least two successive strip movement control devices of the strip treatment installation;

identifying properties of the strip that influence the position of the strip transverse to the transportation direction by the sensors;

assigning the identified properties of the strip to corresponding points or segments of the strip; and proactively adjusting the position of the strip transverse to the transportation direction at the at least one downstream strip movement control device based on the properties for the corresponding points or segments of the strip identified by sensors of the at least one upstream strip movement control device.

2. The method according to claim 1, further comprising:

forwarding the identified properties with the corresponding points or segments of the strip from the at least one upstream strip movement control device to the at least one downstream strip movement control device.

3. The method according to claim 1, further comprising:

transmitting the identified properties with the corresponding points and segments of the strip from the at least two successive strip movement control devices to a computing device; and optimizing, by the computing device, the position of the strip transverse to the transportation direction for transporting the strip through the strip treatment installation based on the transmitted properties with the corresponding points and segments.

4. The method according to claim 3, wherein the optimizing is based on machine learning methods or simulations with an optimization goal of minimizing strip damage, avoiding uneven strip treatment by the strip treatment installation, minimizing a width of the strip treatment installation, avoiding damage to the strip treatment installation, avoiding damage to a transport device or the strip movement control devices, or avoiding unnecessary downtimes of the strip treatment installation.

5. The method according to claim 3, wherein the proactively adjusting of the position of the strip transverse to the transportation direction is performed at the at least one downstream strip movement control device based on the optimizing by the computing device (9).

6. The method according to claim 5, further comprising:

comparing the position of the strip transverse to the transportation direction optimized by the computing device with an actual position of the corresponding points or segments of the strip at the strip movement control devices and, if necessary, adjusting the actual position of the strip transverse to the transportation direction by the strip movement control devices.

7. The method according to claim 6, further comprising:

feeding back deviations between the position of the strip transverse to the transportation direction optimized by the computing device and the actual position of the corresponding points or segments of the strip to the computing device for improving the optimization.

8. The method according to claim 3, further comprising:

taking into account past optimizations with respect to the processing of a further strip by the strip treatment installation when optimizing the position of the strip transverse to the transportation direction by the computing device.

9. The method according to claim 8, further comprising:

training optimization algorithms based on past optimizations with respect to the processing of the further strip by the strip treatment installation.

10. The method according to claim 3, wherein the proactive adjustment of the position of the strip transverse to the transportation direction at the at least one downstream strip movement control device takes into account the adjustment of the position of the strip transverse to the transportation direction carried out at the at least one upstream strip movement control device.

11. The method according to claim 10, wherein the at least two successive strip movement control devices transmit performed adjustments of the position of the strip transverse to the transportation direction to the computing device, and wherein the computing device takes the transmitted adjustments into account when optimizing the position transverse to the transportation direction.

12. The method according to claim 1, further comprising:

taking into account information and/or data from upstream installations arranged upstream of the strip treatment installation for proactive adjustment and/or optimization of the position of the strip transverse to the transportation direction at the at least one upstream strip movement control device.

13. The method according to claim 12, wherein the upstream installations are one or more of: a hot rolling mill, a cold rolling mill, a pickling line, a welding machine, a four-point sensor or quality monitoring system of a welding machine, and a coiling device.

14. The method according to claim 1, further comprising:

determining the position of points or segments of the strip in the strip treatment installation based on tracking systems of the strip treatment installation.

15. The method according to claim 3, further comprising:

detecting the position of the strip transverse to the transportation direction between the at least two successive strip movement control devices and transmitting the detected position to one or more of the at least one upstream strip movement control device, the at least one downstream strip movement control device, and the computing device.

16. The method according to claim 1, wherein a distance between two successive strip movement control devices is smaller at a beginning of the strip treatment installation than at an end of the strip treatment installation.

17. The method according to claim 1, wherein the method is carried out continuously.

18. The method according to claim 1, further comprising:

taking into account current information with respect to the adjustment of the position of the strip transverse to the transportation direction.

19. A control device for operating a strip treatment installation, wherein the strip is guided through the strip treatment installation along a transportation direction by transportation rollers, and wherein the strip treatment installation comprises at least two successive strip movement control devices including at least one upstream strip movement control device and at least one downstream strip movement control device along the transportation direction, and wherein the strip movement control devices are designed to detect and adjust a position of the strip transverse to the transportation direction, and wherein the control device is designed to carry out the following steps:

detecting the position of the strip transverse to the transportation direction by sensors of the at least two successive strip movement control devices of the strip treatment installation;

identifying properties of the strip that influence the position of the strip transverse to the transportation direction by the sensors;

assigning the identified properties of the strip to corresponding points or segments of the strip; and proactively adjusting the position of the strip transverse to the transportation direction at the at least one downstream strip movement control device based on the properties for the corresponding points or segments of the strip identified by sensors of the at least one upstream strip movement control device.

* * * * *